US005781942A

United States Patent [19]

Allen et al.

[11] Patent Number: 5,781,942

[45] Date of Patent: Jul. 21, 1998

[54] WASH STATIONS AND METHOD OF OPERATION

[75] Inventors: Charles S. Allen, Kenilworth, Ill.; Daniel C. Shaw, Geneva; Lee M. Adler, Altamonte, both of Ill.

[73] Assignee: Sloan Valve Company, Franklin Park, Ill.

[21] Appl. No.: 832,847

[22] Filed: Apr. 4, 1997

Related U.S. Application Data

[63] Continuation of Ser. No. 482,994, Apr. 7, 1995, abandoned, which is a continuation-in-part of Ser. No. 729,534, Jul. 15, 1991, abandoned, which is a continuation of Ser. No. 378,921, Jul. 12, 1989, Pat. No. 5,031,258.

[51] Int. Cl.[6] ..... E03C 1/05

[52] U.S. Cl. ..... 4/623; 4/628

[58] Field of Search ..... 4/623, 624, 628

[56] References Cited

U.S. PATENT DOCUMENTS

| | | | |
|---|---|---|---|
| 2,975,719 | 3/1961 | Kaufman | 74/84 R |
| 3,358,747 | 12/1967 | Lesher et al. | 4/623 |
| 3,576,277 | 4/1971 | Blackmon | 222/1 |
| 3,582,234 | 6/1971 | Isreeli | 417/53 |
| 3,639,920 | 2/1972 | Griffin et al. | 4/623 |
| 3,756,752 | 9/1973 | Stenner | 417/477 |
| 4,145,769 | 3/1979 | MacFarlane et al. | 4/623 |
| 4,295,233 | 10/1981 | Hinkel et al. | 4/619 |
| 4,336,619 | 6/1982 | Hinkel et al. | 4/619 |
| 4,398,310 | 8/1983 | Lienhard | 4/623 |
| 4,606,085 | 8/1986 | Davies | 4/623 |
| 4,666,099 | 5/1987 | Hoffman et al. | 242/55.53 |
| 4,742,583 | 5/1988 | Yoshida et al. | 4/313 |
| 4,823,414 | 4/1989 | Piersimoni et al. | 4/623 |
| 4,934,904 | 6/1990 | Williams | 417/388 |
| 4,938,384 | 7/1990 | Pilolla et al. | 222/52 |
| 4,942,631 | 7/1990 | Rosa | 4/623 |
| 4,960,248 | 10/1990 | Bauer et al. | 242/55.53 |
| 5,031,258 | 7/1991 | Shaw | 4/623 |
| 5,199,118 | 4/1993 | Cole et al. | 4/628 X |

FOREIGN PATENT DOCUMENTS

| | | | |
|---|---|---|---|
| 0379118 | 7/1990 | European Pat. Off. . | |
| 0396039 | 11/1990 | European Pat. Off. | 4/628 |
| 4-216726 | 8/1992 | Japan . | |
| 8705352 | 9/1987 | WIPO . | |

*Primary Examiner*—Robert M. Fetsuga
*Attorney, Agent, or Firm*—Joseph W. Berenato, III

[57] ABSTRACT

A wash station comprises a sink and a water dispensing faucet operably associated with the sink for selectively dispensing water thereto. A first sensor is operably associated with the sink for determining the presence of a user. An electrically operated valve is in flow communication with the faucet for causing water to be selectively supplied thereto and operably associated with the first sensor for being actuated thereby. A soap dispensing faucet is operably associated with the sink for selecting dispensing soap. A second sensor is operably associated with the soap dispensing faucet for determining the presence of a user in operable association with the soap dispensing faucet. A pump is in operable association with a soap supply, in fluid communication with the soap dispensing faucet, and in operable connection with the second sensor for causing soap to be selectively supplied to the soap dispensing faucet upon detection of a user by the second sensor.

8 Claims, 8 Drawing Sheets

FIG. 11
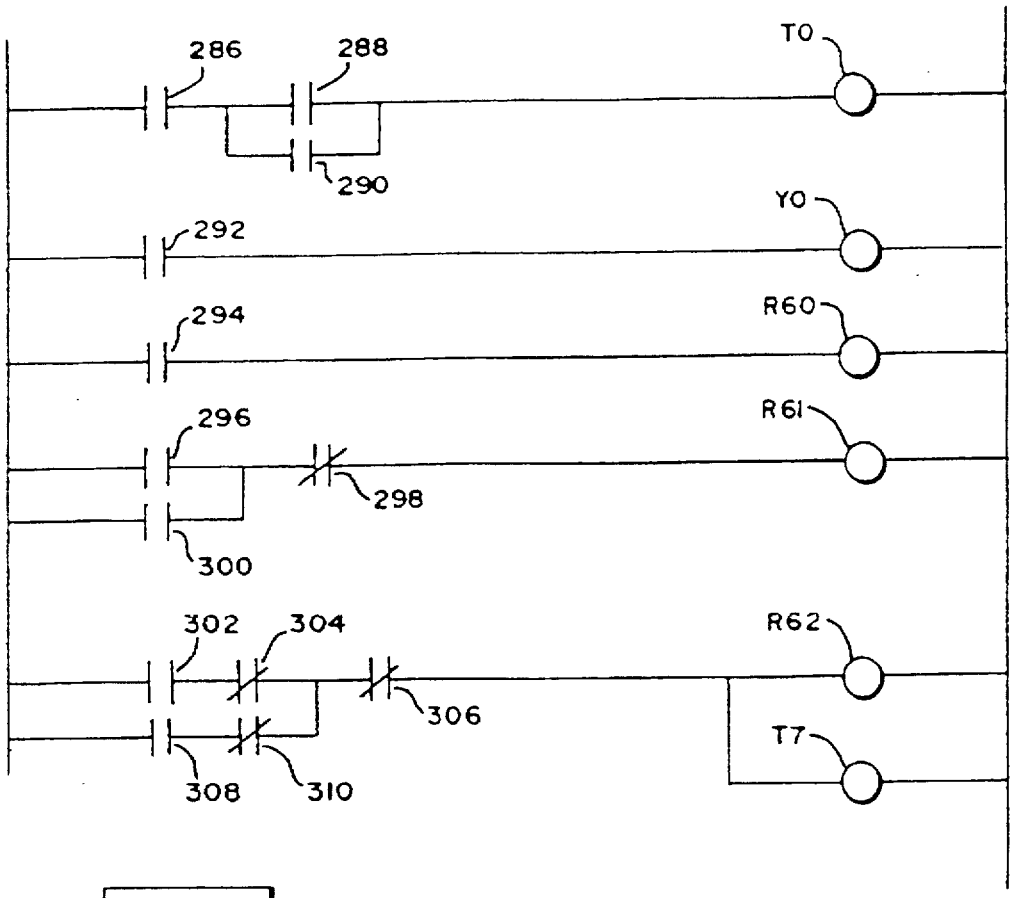
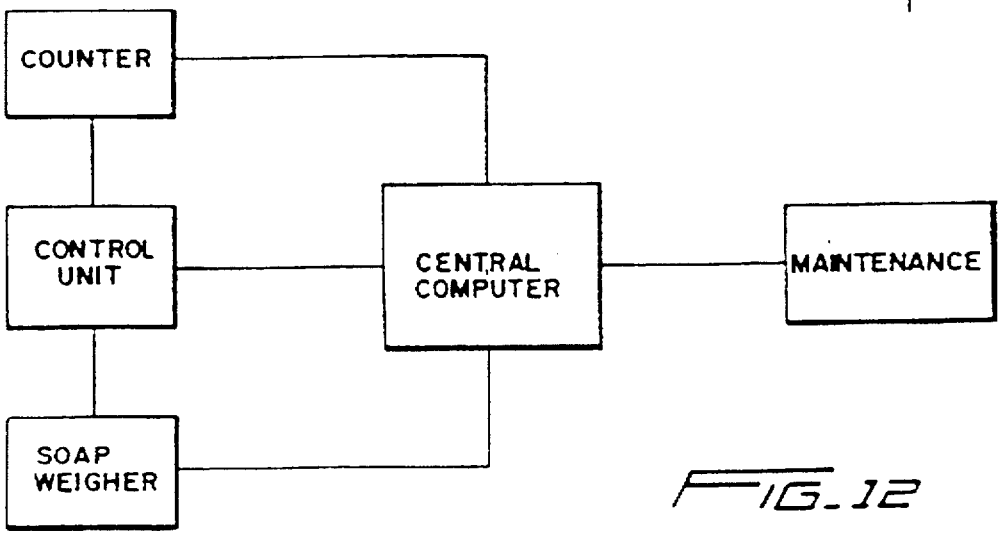
FIG. 12

WASH STATIONS AND METHOD OF OPERATION

This is a request for filing a continuation, application under the file wrapper continuing application procedure, 37 CFR 1.62, of application Ser. No. 08/482,994, filed on Jul. 7, 1995, abandoned, of Charles S. Allen, Daniel C. Shaw, and Lee M. Adler for WASH STATIONS AND METHOD OF OPERATION, which is a CIP of 07/729,534 (Jun. 15, 1991), abandoned, which is a Cont. of 07/378,921 (Jul. 7, 1989), now U.S. Pat. No. 5,031,258).

BACKGROUND OF THE INVENTION

Many diseases are spread from one person to another through contact, whether direct or indirect. Direct contact causes the contagium to be transmitted from the carrier to another, who may become infected and/or pass the contagium on to yet another. Nosocomial infections are particularly prevalent with medical personnel, who may come into contact, knowingly or not, with infectious diseases. Indirect contact occurs when the carrier touches some article, thereby depositing the contagium and permitting it to be contacted by another coming into contact with the article. Many contagia are spread by contact, directly or indirectly with the hands.

Some contagia can be destroyed through the use of water and cleansing agents, such as soaps, antiseptic agents, and the like. Hospital personnel may receive training in the proper method of washing hands, as a means for minimizing the spread of nosocomial infections. Many communities likewise require that individuals handling food wash their hands prior to handling food.

Many hospitals have a wash station which is utilized for the washing of hands. The wash station has a valve, possibly foot or leg operated, for controlling water flow from a faucet to a sink. A source of cleansing agent, such as a liquid soap, is also provided, as are folded paper towels for drying the hands. Hot air dryers are normally not provided in a hospital environment, because the flow of air has a tendency to spread the contagia. Wash stations suffer from numerous drawbacks, such as improper quantity of soap, a need to touch a valve or other potentially contaminated site, and the excessive use of water while the washing operation takes place.

The disclosed invention is a wash station, suitable for both hospital and food-handling establishments. The wash station has infrared sensors for detecting the presence of a user, and a desire for that user to initiate a hand washing operation. Once a potential user is detected, then a control system causes a sufficient quantity of water to be dispensed in order to permit the hands to be wet. A predetermined amount of soap sufficient to cleanse the hands is then dispensed, and a further quantity of water is dispensed in order to permit the hands to be rinsed. Finally, a selected length of roll toweling is dispensed.

Should the user merely desire to run the water, such as to obtain a drink, or to obtain some toweling, then the control system has means to permit these to occur, thereby by-passing the hand washing mode. Operation of the wash station may be monitored by a central computer, which also has the capability of notifying appropriate maintenance personnel if the wash station is not operating properly, or requires servicing.

OBJECTS AND SUMMARY OF THE INVENTION

The primary object of the disclosed invention is to provide a wash station suitable for hospitals and food-handling establishments as a means for minimizing the spread of infectious disease.

A further object of the disclosed invention is to provide a method of operating a wash station which minimizes the risk of infectious disease being spread.

A wash station comprises a sink and a water dispensing faucet operably associated with the sink for selectively dispensing water thereto. A first sensor is operably associated with the sink for determining the presence of a user. An electrically operated valve is in flow communication with the faucet for causing water to be selectively supplied thereto and operably associated with the first sensor for being actuated thereby. A soap dispensing faucet is operably associated with the sink for selecting dispensing soap. A second sensor is operably associated with the soap dispensing faucet for determining the presence of a user in operable association with the soap dispensing faucet. A pump is in operable association with a soap supply, in fluid communication with the soap dispensing faucet, and in operable connection with the second sensor for causing soap to be selectively supplied to the soap dispensing faucet upon detection of a user by the second sensor.

The method of operating a wash station comprises the steps of detecting the presence of a user with a first sensor, and causing water to be dispensed from a faucet upon the user being detected; determining with a second sensor that the user desires soap to be dispensed; and causing soap to be dispensed from a soap dispenser upon the second sensor being actuated and simultaneously prohibiting water from being dispensed through the faucet.

The method of operating a wash station comprises the steps of providing a wash station including a sink, a water dispensing faucet operably associated with the sink, an electrically operated valve in flow communication with the water dispensing faucet for controlling water flow thereto, a first sensor operably associated with the water dispensing faucet for determining the presence of a user, a soap dispensing faucet operably associated with the sink and adjacent the water dispensing faucet, a pump in fluid communication with a source of soap and with the soap dispensing faucet, a second sensor operably associated with the second sensor and the pump for controlling operation of the pump for supplying soap to the soap dispensing faucet, and a controller in communication with the first and second sensors, the valve, and the pump for controlling operation of the valve and the pump. Also included are the steps of detecting with the first sensor the presence of a user, and communicating same to the controller, causing the valve to be operated and thereby causing water to be supplied to the water dispensing faucet, and continuing to supply water to the water dispensing faucet for so long as the first sensor detects a user and so long as the second sensor does not detect a user.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiments of the invention illustrated in the accompanying drawings, wherein:

FIGS. 10 and 11 are schematic wiring diagrams of the embodiment of FIG. 9;

FIG. 12 is schematic diagram illustrating the wash station control system;

DETAILED DESCRIPTION OF THE INVENTION

Figure 1:
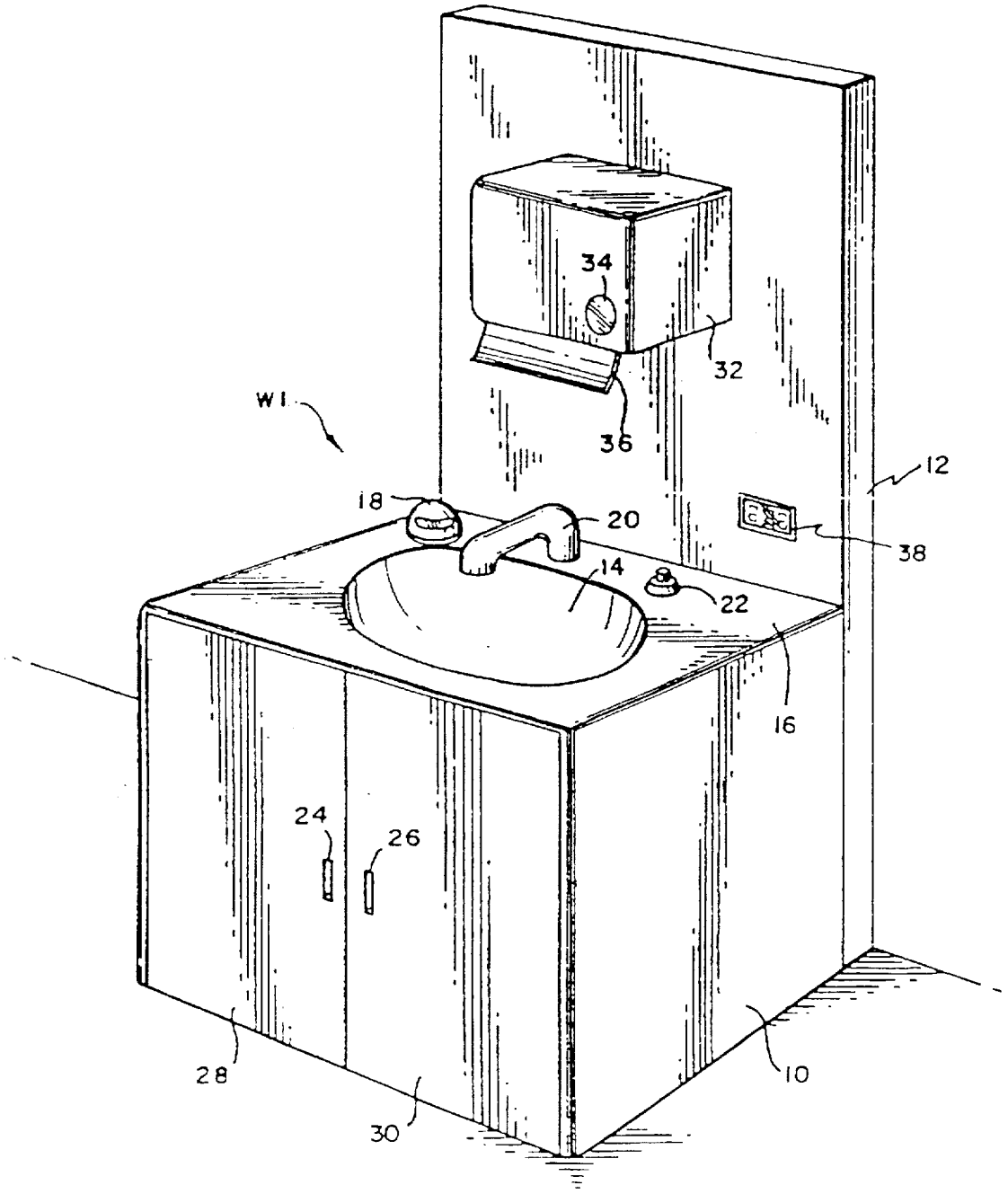
FIG. 1 is a perspective view of a first embodiment of the wash station of the invention.

Wash station W1, as best shown in FIG. 1, has a cabinet 10 and a vertical support 12. The cabinet 10 and support 12 may, as shown, be separate structural elements, or they may be integral or the support 12 might be part of a wall or the like. Also, while we prefer that cabinet 10 and vertical support 12 be manufactured from stainless steel, those skilled in the art will understand that other compositions might be appropriate, such as when wash station W1 is in a restaurant environment.

Sink 14 is mounted to top 16 of cabinet 10. Also mounted to top 16 is an infrared sensor 18, a faucet 20, and a selector switch 22. Cabinet 10 may have handles 24 and 26, permitting doors 28 and 30 to be opened.

An electrically operated roll towel dispenser 32 is mounted to vertical support 12. Roll towel dispenser is, preferably, manufactured pursuant to U.S. Pat. No. 4,960,248, the disclosure of which is incorporated herein by reference and the assignee of which is also the assignee of the present application. Dispensing means 32 has an infrared sensor 34, which may be a passive infrared detector, as compared with the active infrared detector of the sensor 18. Also disclosed in FIG. 1 is a length of toweling 36 extending from dispenser 32, as well as display 38 which indicates the number of uses of wash station W1. While we prefer the use of paper towels, it is merely necessary that a continuous length of tearable drying material be dispensed from dispenser 32. Sheet towels should not be used, because they run the risk of contact with the possibly contaminated dispenser.

Figure 2:
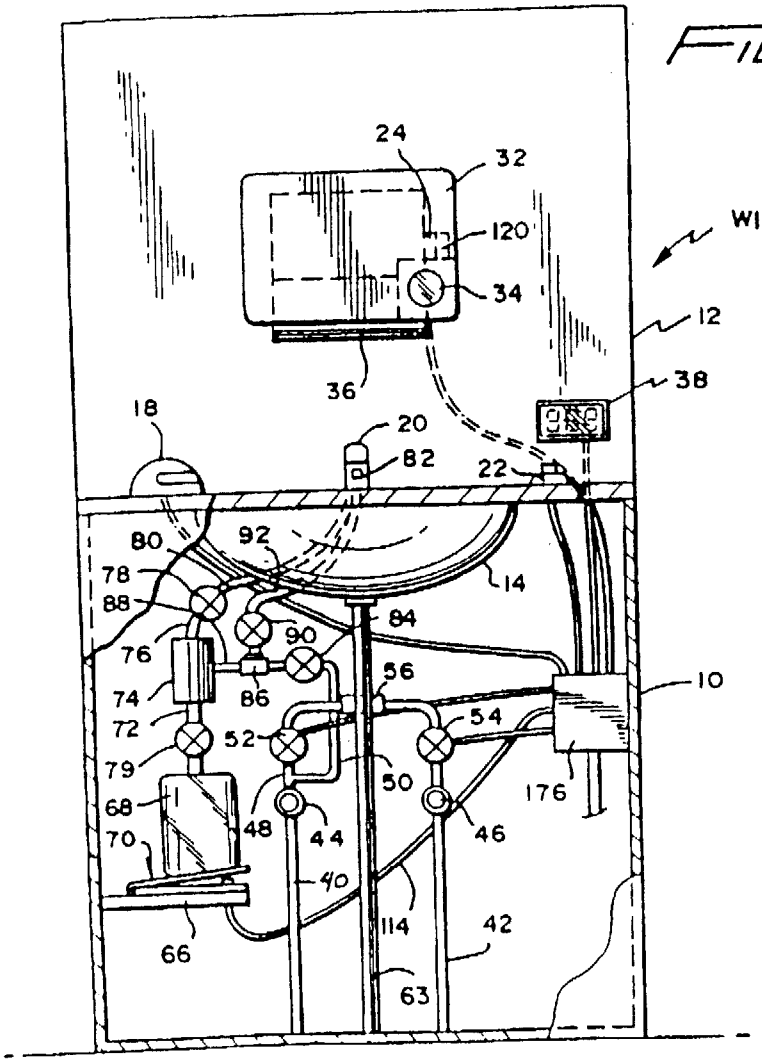
FIG. 2 is a front elevational view thereof, with portions shown in section and broken away.
Figure 7:
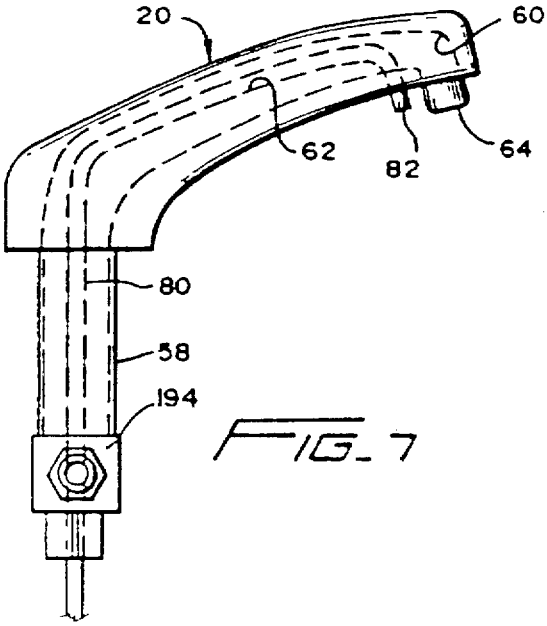
FIG. 7 is a fragmentary elevational view of a faucet of the invention.

As best shown in FIG. 2, cabinet 10 has an open interior in which appropriate operating elements of wash station W1 are located. Hot and cold water lines 40 and 42 are fed from the customary sources provided in most buildings. Manual shut-off valves 44 and 46 are disposed at the upper ends of water lines 40 and 42. A T-connector or fitting 48 extends from the water line above valve 44 and has line 50 extending therefrom, for reasons to be explained. electrically operated solenoid valves 52 and 54 are interposed between valves 44 and 46, respectively, and T-connector 56 to faucet 20 in order to supply water thereto when the normally closed valves 52 and/or 54 are in the open or flow permitting position. The T-connector 56 permits the hot and cold water to be mixed, in order to achieve a desired temperature. Faucet 20, as best shown in FIG. 7, has a water flow channel 60 and an interior soap flow channel 62, and terminates in nozzle 64 for directing water into sink 14 and ultimately from the drain to a sewer or treatment system.

Horizontal support 66 is mounted within cabinet 10, and supports soap container or bottle 68 disposed on weigh apparatus 70. Line 72 leads from soap container 68 to pinch valve pump 74. Line 76 leads from pump 74 to check valve 78, while line 80 leads from check valve 78 to soap channel 62 of faucet 20. Check valve 79 is positioned in line 72 intermediate container 68 and pump 74. Soap channel 62, as best shown in FIG. 7, has a short length of tubing 82 extending from faucet 20 for directing soap into sink 14.

Figure 3:
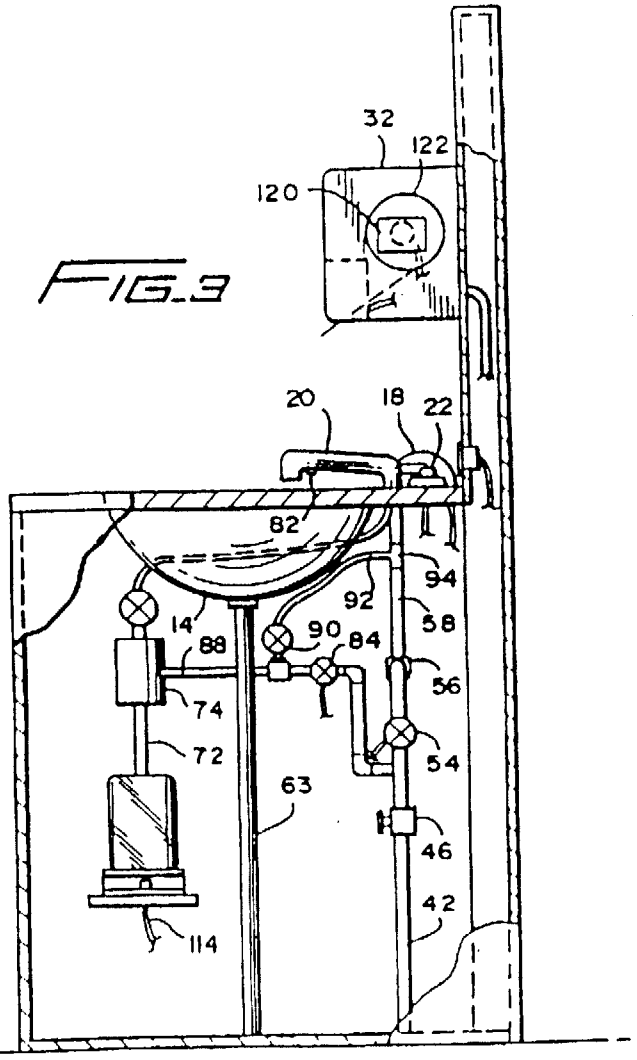
FIG. 3 is a side elevational view thereof, with portions broken away and in section.

Solenoid operated control valve 84 is upstream in line 50 and leads to T-connector 86 to the inlet of pinch valve pump 74 in order to provide pressurizing water thereto. The other outlet of T-connector 86 leads to a control valve or simply a restrictive orifice. Line 92 extends from control valve 90 to T-connector 94 of line 58, as best shown in FIG. 3.

Figure 4:
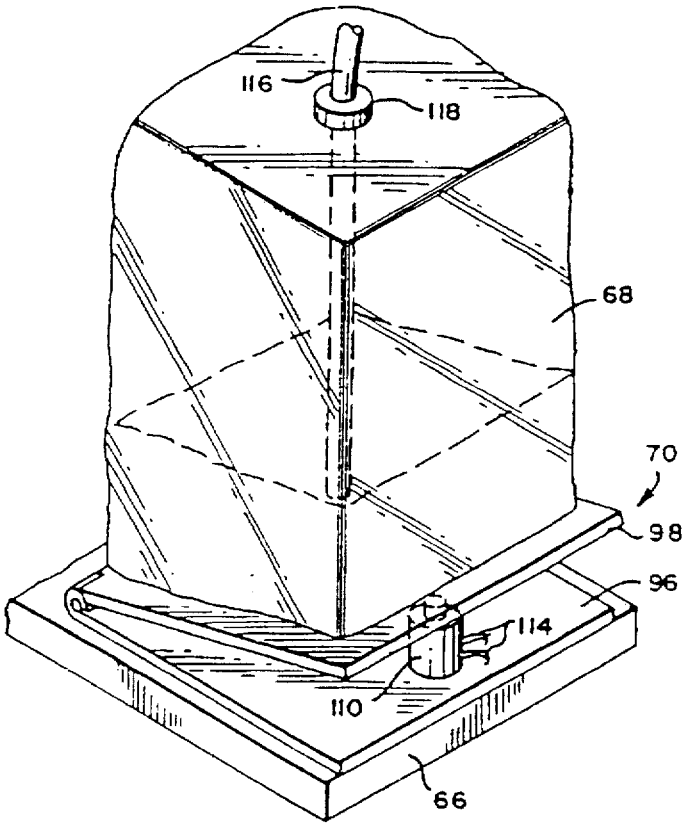
FIG. 4 is a fragmentary perspective view of the soap weigh mechanism of the invention.
Figure 5:
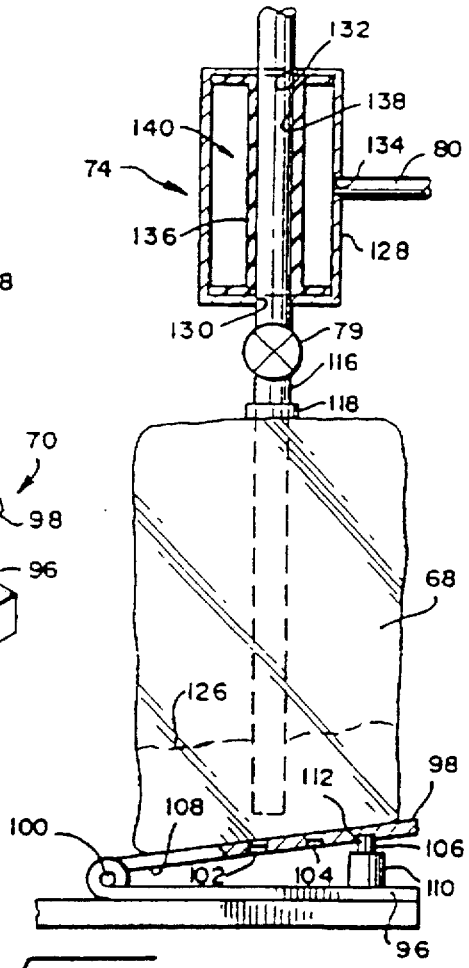
FIG. 5 is a fragmentary elevational view of the soap dispensing system of the invention, with portions shown in section.

Weigh apparatus 70, as best shown in FIGS. 4 and 5, comprises a first support plate 96 resting on support 66, and a second plate 98 overlying plate 96 and hingedly connected thereto by hinge assembly 100. Soap container 68, which, preferably, is a relatively lightweight disposable bottle, rests upon second plate 98. Second plate 98 has a plurality of recesses 102, 104 and 106 formed in surface 108 thereof in spaced relation relative to hinge assembly 100. Pressure switch 110 has a piston 112 selectively positionable in any one of recesses 102, 104 and 106. The weight of soap container 68, including the soap contents thereof, is thereby applied to the pressure switch 110 through piston 112 as a means for monitoring the degree of fullness of the container 68. Electric leads 114 extend from pressure switch 110 as a means for communicating with a central computer, such as shown in FIG. 12, the quantity of soap contained in the container 68.

We have found it desirable to provide flexibility in notifying the central computer when the soap container 68 requires replacement. The weight of the container 68 operating through the hinged assembly 70, exerts a force on the piston 112 which is proportional to the distance between the piston 112 and the hinge assembly 100. In this way, we can selectively position the pressure switch 110 and its piston 112 so that the pressure switch 110 is tripped when a selected quantity of soap remains in the container 68. In this way maintenance can be notified depending upon its response time. We prefer to use a pressure switch, which sends the appropriate signal only when it is tripped, because that minimizes the load on the central computer. Otherwise, the central computer would be required to periodically interrogate the switch 110 as a means for determining the quantity remaining in the container 68. Because the cleansing agent in the container will, most likely, only be slowly consumed, a pressure actuated switch is most feasible.

FIGS. 4 and 5 also disclose the continuous resilient fill tube 116 extending through pump 74 into soap container 68. We provide a sealing disk 118 at the top of container 68, in order to prevent spillage of soap, as well as to provide a frangible opening into which the tube 116 may be inserted. It is to be noted in FIG. 5, that the tube 116 extends through the pump 74. The fill tube 116 must be changed when the container 68 is replaced. This minimizes the possibility of contamination occurring at joints or fittings. This is particularly appropriate in a hospital environment, where the possibility of infection should be avoided as much as possible. In a food-handling environment, however, this may not be as necessary.

Roll towel dispenser 32, as best shown in FIGS. 2 and 3, has an infrared sensor 34. The sensor 34 causes electric motor 120 to operate whenever a user requires toweling. This is particularly appropriate in a hospital environment, where a sudden emergency may preclude the user's completion of the normal wash cycle. Electric motor 120 causes roll 122 of paper towel to rotate by means of one-way transmission 124. This assures that toweling is dispensed through the opening in dispenser 32, and prevents the roll 122 from being wound up.

We have found that a number of different types of pumps may be utilized in causing the cleansing material 126 to be pumped to faucet 20. For example, pinch valve pump 74 has an outer substantially non-deformable cylindrical casing 128 which is closed at the ends thereof, except for openings 130 and 132 which provide, respectively, an inlet and an outlet for tubing 116, as best shown in FIG. 5. A further opening 134 is formed in the side of casing 128 to permit a connection for water line 80.

Resilient bladder 136 is positioned within casing 128, and has a central opening 138 of continuous diameter corresponding to the diameter of the tubing 116, in order to provide a snug fit therewith. This snug fit maximizes the pumping force. Also, the tubing 116 can be relatively thin, and the thickness thereof may be selected based upon the quantity of soap 126 which is to be pumped. The thicker the wall of tubing 116, then the smaller the volume of soap contained in the pumping chamber thereof.

Those skilled in the art will understand that the introduction of water through line 80 into the annular chamber 140 defined by bladder 136 and casing 128 will have the effect of causing the central opening 138 to be squeezed, thereby collapsing the tubing 116. This sudden collapse has the effect of causing the material contained within the tubing 116 to be forced outwardly. Check valve 78 permits the pumped soap to flow from container 68. This is a rapid pumping action, and causes the soap 126 to spurt from tubing 82.

The bladder 136 will remain in the expanded condition for so long as the valve 84 is opened. Once the valve is closed, thereby removing the source of water pressure from line 80, then it is merely necessary to open the valve 90 to allow the water to bleed through to faucet 20 so that the central opening 138 will be expanded again. We prefer that the water released through valve 90 feed into the water flow channel 60. Also, soap will be pulled from container 68 into pump 74.

Figure 8:
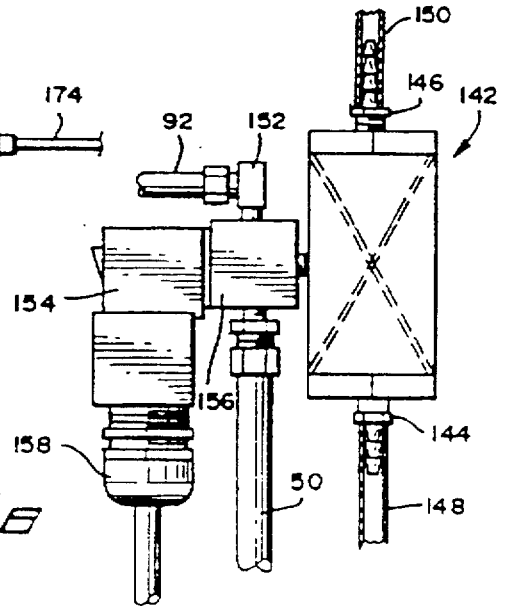
FIG. 8 is a fragmentary elevational view, with portions shown in section, of a further pump system.

Pinch valve pump 142, as best shown in FIG. 8, is similar to pump 74, with the exception that bayonet connections 144 and 146 are provided at the inlet and outlet thereof, respectively. Also, unlike the pump 74, the tube 148 which leads to the soap container 68 does not extend through the pump 142. Likewise, the tube 150 affixed to connector 146 leads to faucet 20. In this way, the central opening 138 of the bladder 136 itself forms the soap conduit. Naturally, check valves are provided before and after pump 142 in order to assure that soap flows to the pump 142 and then to faucet 20.

FIG. 8 disclosed check valve 152, which is, preferably, a ball check valve, which feeds line 92 leading to faucet 20. Normally closed solenoid 154 operates control valve 156 at the discharge end of line 50. Electrical cable 158 supplies the operating power and control signal which causes the solenoid valve 154 to operate. The check valve 152 prevents water from flowing through line 92 into the valve 156, and is sized such that the sudden flow of water from line 50 is substantially diverted into pump 142. The check valve 152 thereby acts as an orifice, allowing the water to bleed once the valve 156 is closed by the solenoid 154.

Figure 6:
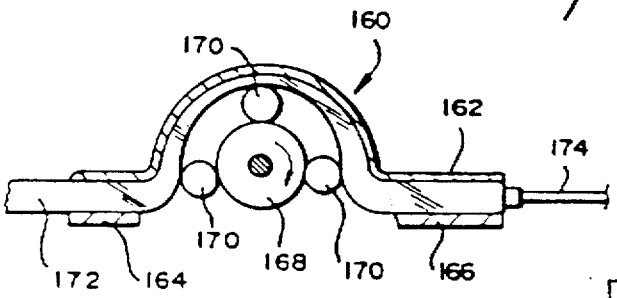
FIG. 6 is a fragmentary elevational view of yet a further means for dispensing soap.

FIG. 6 discloses an electrically operated rotary peristaltic pump which is also useable for causing the cleansing material 126 to be pumped to the faucet 20. The pump 160 has a removable cover 162 overlying supports 164 and 166. Central shaft 168 is rotated by an electric motor (not shown). Shaft 168 carries fingers 170 along the periphery thereof, for engagement with resilient soap supply conduit 172. Conduit 172 feeds soap line 174 leading to faucet 20.

Rotation of shaft 168 causes the fingers 170 to selectively engage the conduit 172, thereby causing same to be compressed against the cover 162. This is a rolling type of motion, having the tendency of forcing the soap toward soap line 174 as rotation continues. Rotation of shaft 168 in the opposite direction causes the soap to be pulled into conduit 172 from line 174, thereby minimizing the possibility of soap dripping from line 174 into sink 14.

The cover 162 is removable from its overlying relation to the shaft 168 and supports 164 and 166, thereby facilitating replacement of the soap conduit 172, after the soap in the container 68 has been consumed. This is an effective means of minimizing contamination which might find its situs at a fitting. It should be appreciated that the soap container and conduit may be an integral unit, thereby facilitating replacement.

As earlier noted, push button selector switch 22 is mounted to upper surface 16 of cabinet 10 adjacent faucet 20. The selector switch 22 is a two position switch. We have found that there are occasions when a user may merely desire water, such as for drinking. In such instance, the selector switch 22 is an effective means for permitting only water to be dispensed from the faucet 20. As noted, roll toweling is available from the dispenser 32 at all times because of the second sensor 34. Display 38 will not be operated when the push button switch 22 is in the water only position, because the display 38 is operated by controller 176, and is only advanced when soap is pumped.

All electrical controls for the was station W1 reside in the electronic controller 176, which is positioned within cabinet 10. The controller 176 may be hardwired, or may be a programmable controller. The controller 176 has the functions of receiving all required electrical signals for the display 38, and the solenoid-operated valves 52, 54, 84, 90 and 78. The central controller 176 will, preferably, communicate with a host computer.

Figure 9:
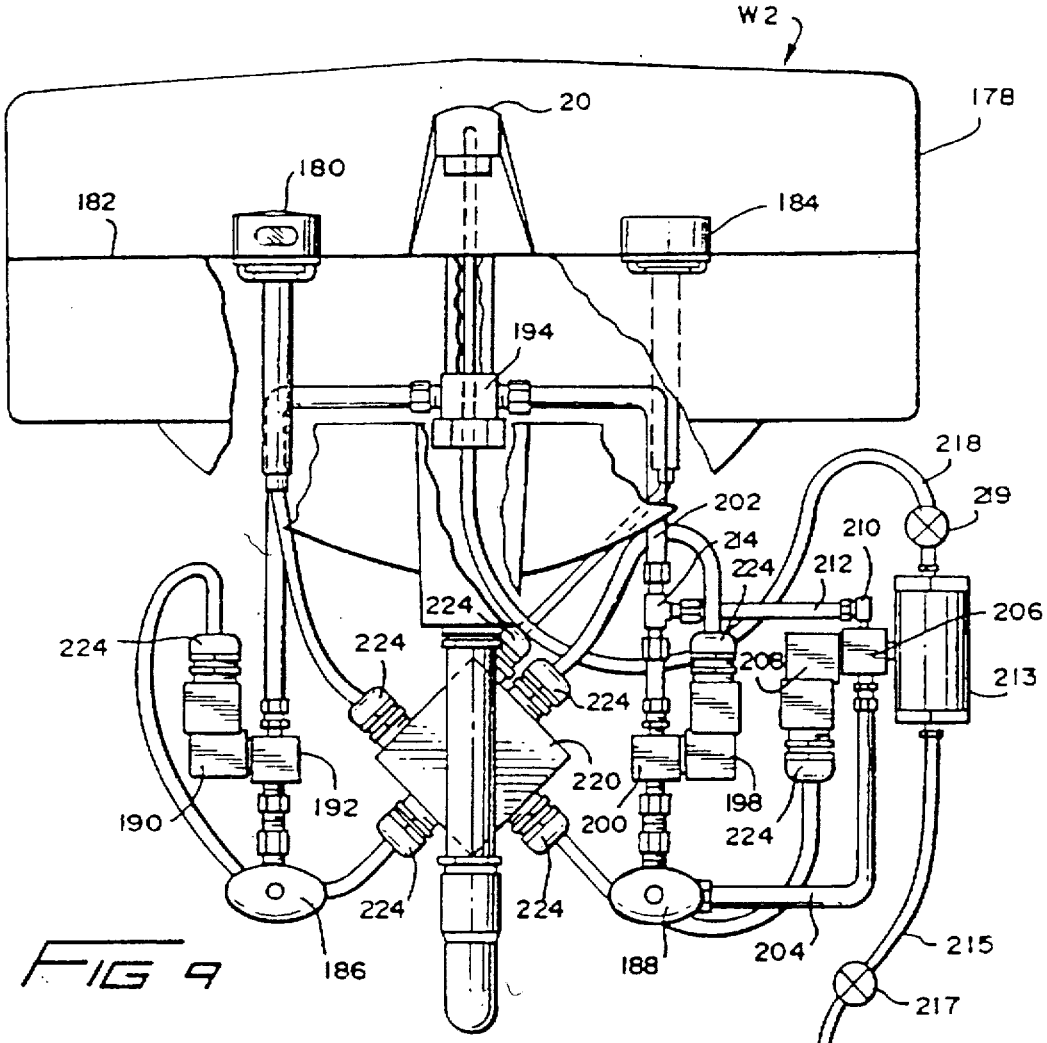
FIG. 9 is an elevational view with portions broken away of yet a further embodiment of the wash station of the invention.

FIG. 9 discloses wash station W2. Wash station W2 may be adapted for use with a sink 178 which is of conventional design. A first infrared sensor 180, which is, preferably, of the active type, is mounted to surface 182 of sink 178 and is used for determining the presence of the hands of a user beneath faucet 20. The faucet 20 of wash station W2 is substantially the same as faucet 20 of wash station W1, and no further discussion thereof is seen to be necessary.

Also mounted to surface 182 is second sensor 184, which is also of the active type. The sensor 184 looks upwardly, however, as opposed to the sensor 180 which looks horizontally. In this way, the eye of the sensor 180 may be thought of as operating on a horizontal plane, while the eye of the sensor 184 operates on a vertical plane extending substantially transverse to the plane of the sensor 180. This relationship avoids possible confusion to the controller 176 on account of inaccurate positioning of the hands of a user.

Wash station W2 has manual water supply valves 186 and 188 providing a source of pressurized water to the wash station W2. Normally closed solenoid 190 operates control valve 192 for causing water to selectively flow to T-connector 194 through line 196. Similarly, normally closed solenoid 198 operates control valve 200 for permitting water to flow through line 202 to T-connector 194. Line 204 leads from manually operated valve 188 to control valve 206. Valve 206 is operated by normally closed solenoid 208. Check valve 210 feeds line 212 which communicates with line 202 through T-connector 214. Pump 213, which is substantially the same as the pump 142 of FIG. 8, has soap supply line 215 leading from soap container 216. Soap line 218 extends from the outlet of pump 142 to conduit 80. Naturally, check valves 217 and 219, which may be ball check valves, are interposed between container 216 and faucet 20 in order to control pumping of the soap.

Control box 220 is mounted to a vertical support behind drain 222. Electric lines extend from the control box 220 to each of the pieces of equipment, and preferably the lines have strain relieving plug assemblies 224 to minimize deterioration of the electrical cable.

We have found that the sensor 184 is preferable to the push button 22, particularly in hospital environments. The sensor 184, by looking upwardly, need not be contacted by the user, and thereby minimizes the risk of infection due to prior contact. In order to have the control box 220 switch the wash station W2 between the hand washing and water only modes, it is merely necessary for the user to place his or her hand over the sensor 184 for a sufficient period of time. We have found that a sense time of approximately three seconds is sufficient, and avoids unintended tripping which could occur if a hand was moved rapidly across the scan zone of the sensor 184. Also, we prefer that tripping of the sensor 180 be required within a selected time upon the wash station W2 being set in the wash mode by the sensor 184. This is a further means of assuring that unintended operation does not occur. In other words, first put the wash station in the hand wash mode, and then put the hands under the faucet.

FIG. 12 discloses a schematic diagram by which the wash stations W1 and W2 are connected to a host or central computer. The control unit, which corresponds to the controller 176 (or control box 220) of the wash station W1, operates both the display 38 and the soap weighing mechanism 70. Also, the control unit feeds relevant operating information to the central computer which, if necessary, notifies maintenance of the need to take action with regard to the relevant wash station. The display 38 and the soap weighing mechanism 70 communicate with a central computer, through the controller 176, as may be desired. This permits the central computer to periodically query the display and the soap weigher in order to monitor usage of the wash station.

Figure 10:
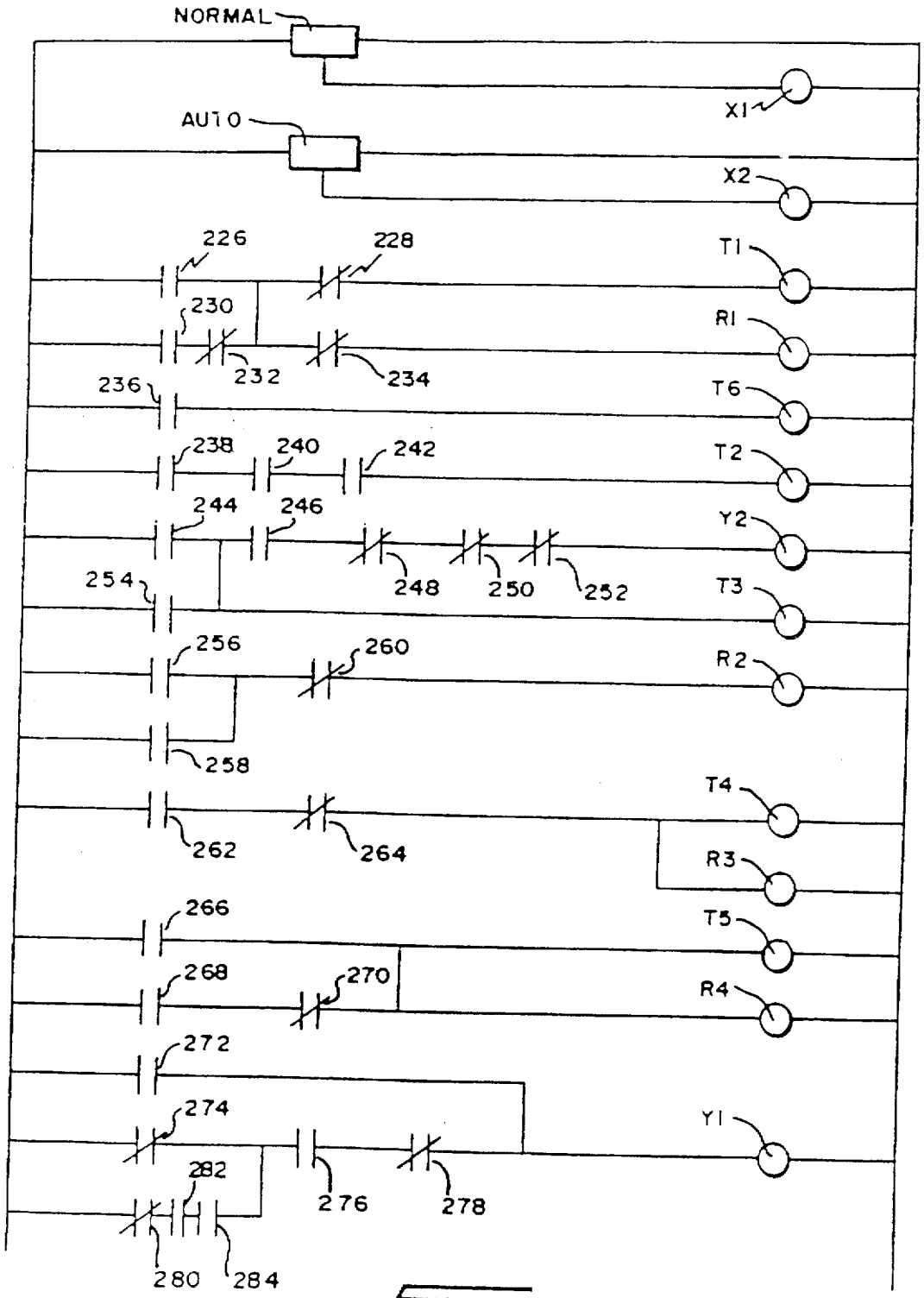

FIGS. 10 and 11 disclose the wiring diagram by which the wash stations W1 and W2 are constructed. Those skilled in the art will appreciate that the wiring diagram of FIGS. 10 and 11 may be assembled by hard wiring, or may be achieved through software control, such as with a programmable controller.

The box "Normal" indicates the condition which the wash stations W1 and W2 are normally in, and water only is dispensed when in this mode. In the normal mode, relay or output X1 is energized.

Normally open contacts 226 of timer T6 must be closed for current to feed through the normally closed contacts 228 of relay R4 to timer T1. This provides a reset feature, so that if a potential user puts the system into automatic, then the user must make some motion in the view field of sensor 18 within a selected time as set by timer T1. Should nothing occur during the 40 second period, then timer T1 runs out, thereby resetting the control system to the normal mode. The reset is only necessary when in the automatic mode.

Normally open contacts 230 of relay R1 are closed during the time that timer T1 is running, thereby providing a holding circuit because the contacts 232 of the timer T1 are normally closed, as are the contacts 234 of relay R4. The contacts 230 are internal to the relay R1, and cause a constant control signal to be applied, since the timer T1 will only supply a control signal upon the expiration of the allotted time.

The normally open contacts 236 of the relay X2 cause timer T6 to be operated. Timer T6 is the timer which determines when the user has placed his or her hand over the sensor 184 for a sufficiently long period. We have found that approximately three seconds are sufficient to make certain that the user wishes to switch the wash station W2 to the automode.

Normally open contacts 238 of relay R1, 240 of relay X1, and 242 of timer T0 control operation of timer T2. Timer T0 provides a one second pause, which is desired in order to give the user sufficient time to place his or her hands under the faucet 20. Once the timer T0 times out, them timer T2 causes a 0.1 second spurt of water to flow to the faucet 20 by operation of the valves 52 and 54 or 192 and 198, depending upon the wash station being used. This spurt of water is sufficient to wet the hands.

Normally open contacts 244 are internal to relay T2. The contacts 244 lead to normally open contacts 246 which are internal to relay X1. The contacts 246 feed normally closed contacts 248 which are internal to timer T3. The contacts 248 feed normally closed contacts 250 which are internal to relay Y2 to operate. The relay Y2 energizes the pump 160, or causes operation of pump solenoids 84 or 206.

Normally open contacts 254 are internal to relay Y2, and feed timer T3. The timer T3 is, preferably, set for approximately four seconds in order to provide adequate soap from the pump. Should pinch valve pumps 74 or 142 be utilized, then the time need not be as long as four seconds.

Normally open contacts 256 are internal to relay Y2. Likewise, normally open contacts 258 are internal to relay R2. The contacts 256 and 258 feed normally closed contacts 260 which are internal to timer T4. The contacts 260 feed relay R2 and provide a holding circuit for that period of time between initiation of timer T3 and its termination.

Normally open contacts 262 are internal to relay R2 and feed normally closed contacts 264 which are internal to relay Y2. The contacts 264 feed timer T4 and the hold-in relay R3. We have found that the time T4 should be set for approximately 15 seconds, and this provides sufficient time for the user to lather his or her hands after the soap has been pumped. During this waiting period, water is not permitted to flow to the faucet 20. Normally open contacts 266 are internal to relay T4, and feed timer T5. Likewise, normally closed contacts 270 which are internal to timer T5. Activation of timer T5, along with the hold-in circuit provided by the relay R4, cause the water to be dispensed from the faucet 20 for a period of five seconds. We have found that operation of the solenoid valves 52 and 54, or 192 and 198, for a period of five seconds is sufficient to wash the lathered soap from the hands of the user.

Normally open contacts 272 are internal to relay R4, and feed relay Y1 which controls the water solenoid 52 and 54, or 192 and 198. Likewise, normally closed contacts 274 are internal to relay R1, and feed normally open contacts 276 of relay X1. Contacts 276 feed the normally closed contacts 278 of relay R3. The normally closed contacts 280 of timer T2 feed the normally open contacts 282 of the timer T0. The contacts 282 feed the normally open contacts 284 of the relay R1.

As noted, we provide timer T0 in order to assure sufficient time for the user to place his or her hands under the faucet 20. The timer T0 is controlled by the normally open contacts 286 of relay R1, as well as the contacts 288 and 290 of respectively, relay X1 and timer T0.

Normally open contacts 292 of relay R62 cause operation of relay Y0. The relay Y0 controls operation of the motor 120 of roll towel dispenser 32. This assures that toweling is always available, regardless of what other function the wash station may the be performing.

The normally open contacts 294 of relay X1 operate relay R60, and assure that toweling is dispensed, when in the normal mode, only when the user has taken his or her hand away from the sensor 34. We have found that there may be occasions when some article or the like may mistakenly actuate sensor 34. This can be prevented if the motor is permitted to operate after the detected "person" has moved his or her hand away from the sensor 34. Otherwise, if the hand is not moved, then toweling will not be dispensed.

The normally open contacts 296 of the relay R60 feed the normally closed contacts 298 of the relay R62. Likewise, the normally open contacts 300 of the relay R61 feed the contacts 298.

The normally open contacts 302 of the relay R61 feed the normally closed contacts 304 of the relay R60. The contacts 304 feed the normally closed contacts 306 of the relay R4. The contacts 306 feed relay R62 and timer T7. Likewise, the normally open contacts 308 of relay R62 feed the normally closed contacts 310 of the timer T7. The contacts 310 feed the contacts 306. This assures that a predetermined length of toweling is dispensed from the dispenser 32, because the motor 120 is cause to operate for a predetermined time.

OPERATION OF EMBODIMENTS W1 AND W2

Operation of the wash stations W1 and W2 is essentially automatic, because of the sensors 18 and 180, as well as the selector switches 22 and 184. It is merely necessary that the user approach the wash station, and then take the desired action, whether requesting hand washing or water, or merely requesting that toweling be dispensed.

The wash stations W1 and W2 are normally in the "water dispensing" mode, meaning that a user will cause water only to be dispensed from the faucet 20 when his or her hands are placed under the faucet 20, and thereby in the detection zone of the sensors 18 or 180. In that event, then the contacts 274, 276 and 278 assure that the water continues to flow for so long as the hands or object, such as a pitcher, are under the spout. Should the user take his or her hands away, then the contacts 280, 282 and 284 and timer to cause the water to continue to flow for one second after the hands have been removed. We have found this delay desirable, because it is not unusual for a user to unintendedly remove his or her hands from the detection zone of the sensors 18 or 180. The delay period, therefore, prohibits rapid cycling of the control valves 52 and 54 or 192 and 198. This minimizes wear on the system, without wasting much water.

Should the user desire that toweling be dispensed from the dispenser 32, then it is merely necessary that he or she place a hand in front of the sensor 34 and then remove same. This causes initiation of the motor 120, for a period set by the timer T7. Any diminishment in length due to changes in the diameter of the roll 122 are fairly minimal.

Should the user desire to use the wash station for washing of the hands, then this may be accomplished easily. It is merely necessary that the push button 22 be pressed, or that the user place his or her hand over the sensor 184 for the required period. Once a hand has been placed over the sensor 184 for the desired time, then the controller 220 (or 176) places the wash station into the automatic or hand washing mode.

Once in the automatic mode, then it is necessary that the user place his or her hands under the faucet 20 within the detection range or field of the sensors 18 or 180 for the period specified by timer T1. This assures that the user does not put the wash station into the automatic mode, and then walk away. Should that event occur, then timing out of the timer T1 causes the system to reset to the normal mode.

Assuming that the user places his or her hands within the target zone of the sensors 18 or 180, then the solenoid operated valves 52 and 54, or 192 and 198, are caused to operate for supplying sufficient water to permit the hands to be wet. Most cleansing agents are water soluble, and that it is desired, as with normal hand washing, that the hands be wet prior to application of the liquid soap. This does not require much water, and only enough to wet the hands is necessary.

Once the hands have been wet, then the controller 220 (or 176) causes soap to be pumped by operation of any of the pumps 74, 142 or 160. We can control the quantity of soap which is pumped by either regulating the thickness of the tubing within the central opening 136 of the pumps 74 or 142, or else by regulating the pumping time of the peristaltic pump 160. Those skilled in the art understand that insufficient soap is undesirable, but equally as undesirable is too much soap. Regulation of the pumping volume is therefore an appropriate means for assuring an adequate amount of soap, based upon the particular soap being used.

Once the soap has been pumped, then no water is permitted to flow to the faucet 20 for the period specified by timer T4. We have found that 15 seconds are sufficient for the typical user to thoroughly lather his or her hands. Once lathering has occurred, as noted by the timer T4, then the timer T5 causes five seconds of water to be dispensed. This is a sufficient quantity to rinse the soap from the hands.

Operation of the solenoid valves 52 and 54 or 192 and 198 for dispensing rinse water cause relay R62 to be energized, thereby causing timer T7 to activate so that toweling is dispensed for the selected period. The user may then tear the toweling from the dispenser 32, and dry his or her hands. In this way, the user is not required to come into contact with any part of the wash station W1 or W2 after the hands have been cleansed. Therefore, the spread of infection is minimized, because the wash stations W1 and W2 assure proper cleaning of the hands.

Figure 13:
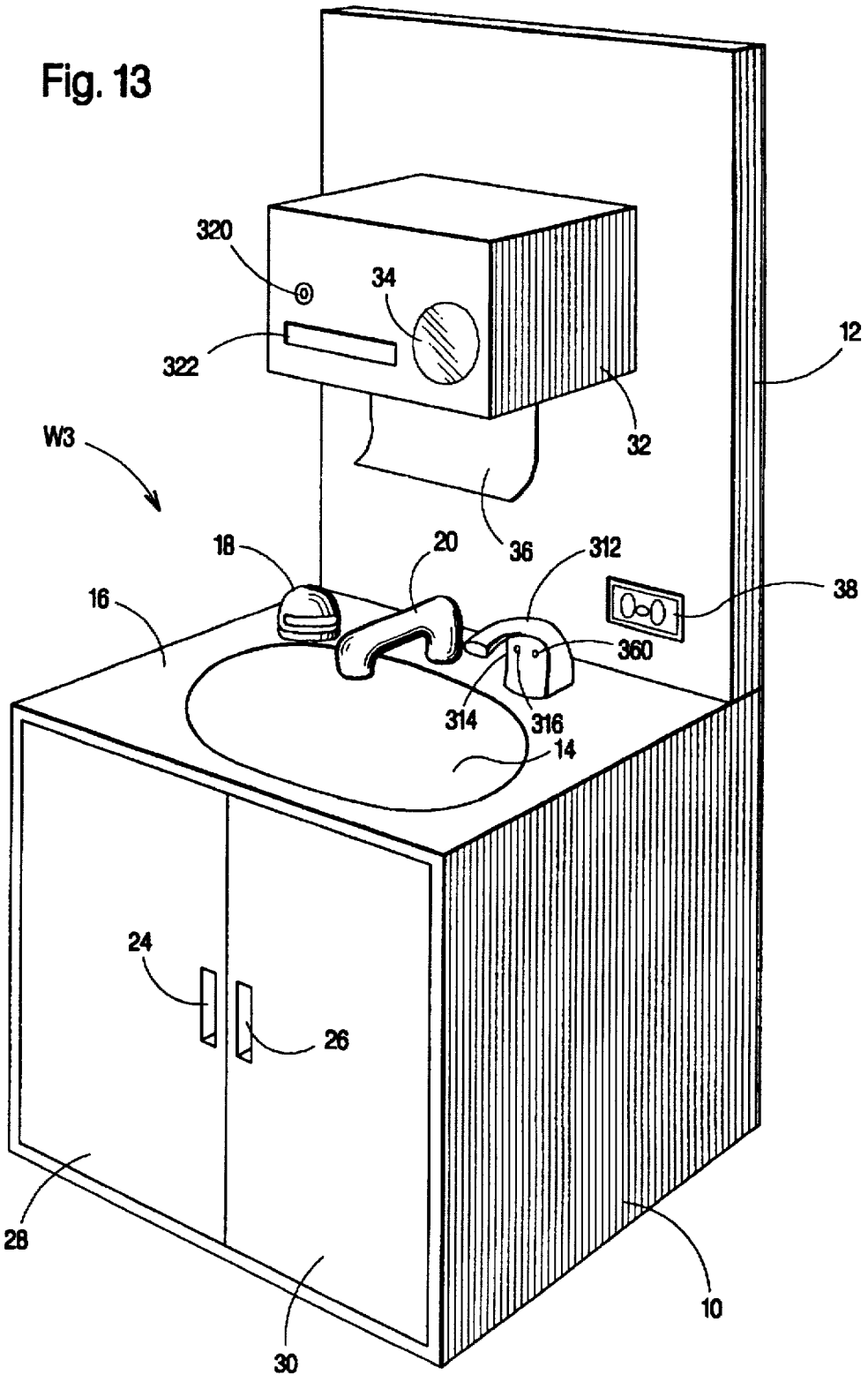
FIG. 13, is a perspective view of a third embodiment of the wash station of the invention.

FIG. 13 illustrates wash station W3 which is similar to the wash station W1 of FIG. 1. Because of the similarities, then like numbers indicate like components. The wash station W3 principally differs from the wash station W1 because there is a separate soap spout triggered by a separate sensor, and there is a push button to provide for water to be dispensed for an extended period. In addition, an alphanumeric display is provided to provide information to the user.

As best shown in FIG. 13, soap spout 312 is adjacent water dispensing faucet 20, and is secured to top 16. Spout 312 has a nozzle 314 which lies above sink 14, and through which soap, bactericide, or a suitable anti-microbial agent is dispensed. The soap supplied to nozzle 314 is supplied from any of the pumps herein disclosed, or any other suitable pump. Preferably the pump is a peristaltic pump of the type illustrated in FIG. 6.

Incorporated into spout 312 is an active infrared sensor system for actuating the pump in order to cause soap to be dispensed. Lenses 316 and 318 are provided for transmitting the infrared signal, and for receiving the reflected signal, respectively. Soap will not be dispensed until the user has triggered the sensor system of spout 312 by placing his or her hand in operative relationship for indicating by reflection of the light that soap is desired. Thus, a user placing his or her hands under faucet 20 will cause water to be dispensed for so long as those hands are so positioned, and the wash station W3 will not be placed into the "hand washing" mode until the sensor of spout 312 is actuated.

There are occasions when there is a need for water to be dispensed from faucet 20 for an extended period, such as to fill a pitcher or the sink 14. In those instances, however, the user may not wish or be able to maintain his or her hands suitably positioned relative to sensor 18 for maintaining water flow. Push button 320 is therefore provided, optionally at towel dispenser 32, for this purpose. The push button 320 may be a suitable button which stays locked until pushed again, or time controlled or otherwise, so that water will flow to faucet 20 for so long as the push button 320 is actuated.

Wash stations such as those disclosed herein will typically be located in places in which they will be confronted by potential users of varied backgrounds and training. The wash station should be able to be used properly by all of these individuals in order to permit maximization of its benefits. For this reason, an alphanumeric display 322 is provided in order to provide information for the user, such as instructions for use. The display 322 may be incorporated into the towel dispenser 32, or may be otherwise located. The alphanumeric display thus is readily observed by the user, and may not only provide instructional information but other information, such as time elapsed, time to next step, etc., which will help to keep the user at the wash station W3 for the duration of the hand wash cycle. Additionally, the display 322 may also be used to provide information to the hospital, for example, on total number of uses, total number of proper uses, and other information permitting the hospital to determine that the wash station W3 is being properly used and how frequently used.

Figure 14:
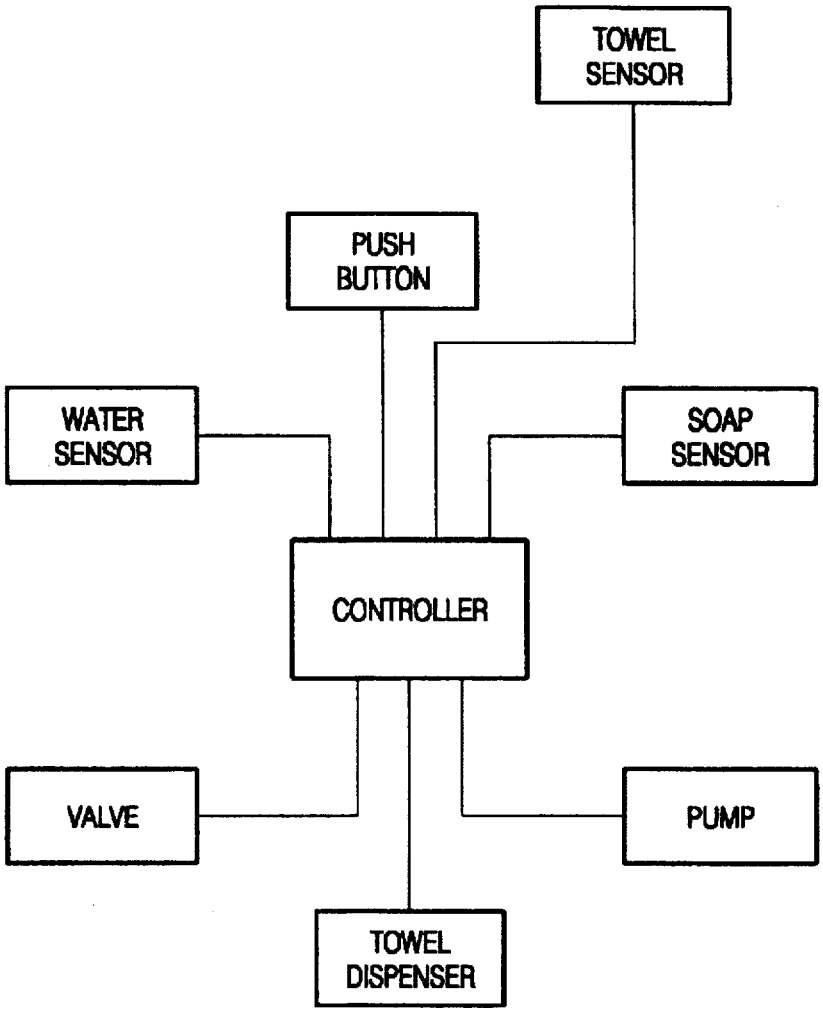
FIG. 14 is a block diagram illustrating the control system of the invention.

FIG. 14 illustrates the control system of the wash station W3. As illustrated therein, a controller, which may be a microprocessor or programmable controller, has inputs from the water sensor 18, the soap sensor 316, 318, and the towel dispenser sensor 34. Towel dispenser sensor 34, in this embodiment, preferably is an active infrared sensor. The outputs from the controller are to the valve, such as either or both valves 52 and 54, the pump, such as peristaltic pump 160, and towel dispenser 32.

Typically a user will approach the wash station W3 and place his or her hands under faucet 20, there permitting sensor 18 to detect the presence of a user. As a result, controller will cause the valve to the faucet 20 to be operated, with the result that water will flow thereto. Water will continue to be dispensed for so long as the sensor 18 detects a user. Alternatively, water will continue to be dispensed for so long as push button 320 is operated.

Should the user desire to wash his or her hands, then they must first be wet with water. This is done by having the hands placed under the faucet 20 within the operating range of sensor 18. The user next places at least one hand under spout 314 within the operating range of the sensor acting through lenses 316 and 318. Actuation of the soap sensor in this way sends a signal which communicates to the controller that it should switch from the water dispensing mode in which it normally is placed to the second or hand washing mode. This sequence thus differs from the previously described sequence in which the wash station W1 was first placed into the hand wash mode and then a controlled amount of water dispensed. The wash station W3 is therefore more user friendly. It is thus the dispensing of the soap which switches the controller into the hand washing mode.

Once in the hand washing mode, then the control of water and soap is based upon the preprogrammed sequence earlier explained. Thus, the pump is actuated to dispense soap through nozzle 314, while the flow of water to faucet 20 is stopped. Once the hands have had sufficient time to be lathered, then water is again dispensed through faucet 20. Once sufficient water is dispensed, then the water valve closes, and towel 36 is dispensed from dispenser 32 by virtue of its electric motor.

The alphanumeric display 322, which may be a CRT screen, liquid crystal display, or the like, is also actuated by the controller to provide information to the user. Thus, for example, display 322 may initially be set to display to the user that wash station W3 is in the water only mode. Once soap is dispensed by the controller being switched to the hand washing mode, then the display may inform the user the step then underway, how much time remains until initiation of the next step, and similar information.

In addition to the above, alphanumeric display 322 may also provide other sorts of information having the intent of keeping the user at the wash station W3 for the duration of the hand washing cycle. An individual may be reluctant to appear to be taking instructions from wash station W3 or may become impatient during the hand washing sequence. Thus, display 322 may provide information such as hand washing frequency, general purpose information such as about the importance of hand washing, or even more general information about current events. The purpose is to keep the user at the wash station W3 so that the hand washing sequence will be satisfactorily completed.

While this invention has been described as having a preferred design, it is understood that it is capable of further used, modifications and/or adaption as come within known or customary practice in the art to which the invention pertains, and as may be applied to the central features hereinbefore set forth, and fall within the scope of the invention and the limits of the appended claims.

We claim:

1. A hand washing station including different modes for placing the station in each of (i) an automatic user friendly hand washing mode, and (ii) a separate and distinct water dispensing mode, the hand washing station comprising:

a sink;

a water faucet operably associated with said sink for selectively dispensing water;

water dispensing mode means for dispensing pre-soap water, and for operation when the station is in said water dispensing mode, said water dispensing mode means including (i) a first sensor having an operating range for detecting the presence of a user; (ii) means for dispensing pre-soap water from said water faucet when the station is in the water dispensing mode only so long as the presence of the user is detected within said operating range of said first sensor; and (iii) a first electrically operated valve for selectively causing said water faucet to dispense water in response to the user being detected within said operating range of said first sensor;

means for changing the hand washing station from said water dispensing mode to said user friendly hand washing mode, said means for changing including a second sensor integral with a soap dispensing faucet so that the hand washing station is switched from said water dispensing mode to said automatic hand washing mode when the user leaves the operating range of said first sensor and enters an operating range of said second sensor proximate said soap dispensing faucet;

hand washing mode means for operation when the station is in said user friendly hand washing mode following the water dispensing mode, said hand washing mode means, in accordance with a preprogrammed sequence, for (a) actuating a first pump, in operable association with a soap supply and said second sensor, to cause a preprogrammed amount of soap to be dispensed through said soap dispensing faucet, without first causing said water faucet to dispense water; (b) after said preprogrammed amount of soap has been dispensed, automatically causing said water faucet to dispense water for a preprogrammed period of time; and (c) after said preprogrammed period of time has elapsed, dispensing a towel from a towel dispenser;

wherein when the user desires to wash his or her hands with soap, the user first actuates the water dispensing mode via said first sensor to wet his or her hands and thereafter puts his or her hands proximate said soap faucet in order to actuate said hand washing mode via said second sensor so as to get soap and toweling, and said soap faucet in the hand washing mode dispensing soap before said water faucet dispenses water, thereby rendering the hand washing station more user friendly;

a push button (320) for causing water to be dispensed from said water faucet for so long as said push button is actuated thereby enabling water to be dispensed from said water faucet for an extended period when the user's hands are not within the operating range of said first sensor or said second sensor; and a microprocessor-based controller in operative communication with said first sensor, said second sensor, said first valve, said first pump, said push button, and a third sensor located on said towel dispenser, and wherein said controller outputs signals to said towel dispenser, said first valve, and said first pump so that said microprocessor-based controller enables soap, water, and toweling to be dispensed in said modes, and wherein actuation of said second sensor causes soap to be dispensed and causes a signal to be sent to said microprocessor-based controller that causes said controller to switch from said water dispensing mode to said automatic hand washing mode so that the dispensing of soap effects actuation of said hand washing mode.

2. The hand washing station of claim 1, further including means for causing a display to inform the user how much time remains of water dispensing when the station is in said hand washing mode.

3. The hand washing station of claim 2, wherein said water faucet is adjacent said soap dispensing faucet, and wherein said first and second sensors are infrared sensors.

4. The hand washing station of claim 3, wherein said first sensor is remote from said soap faucet, and wherein said display is an alphanumeric display and is proximate one of said water faucet and said soap dispensing faucet.

5. The hand washing station of claim 4, further comprising a controller, located vertically beneath said sink, in electrical communication with said first and second sensors so that said controller causes operation of said first valve when said first sensor detects the user within its operating range, and said controller causes operation of said pump when said second sensor detects the user within its respective operating range.

6. The station of claim 5, including a third sensor mounted on said towel dispenser for causing toweling to be dispensed when said third sensor detects a user.

7. The station of claim 1, wherein said push button includes means for staying locked after being actuated a first time until being actuated a second time.

8. The station of claim 7, wherein said push button is integrally formed with said towel dispenser.

* * * * *

UNITED STATES PATENT AND TRADEMARK OFFICE

CERTIFICATE OF CORRECTION

PATENT NO. : 5,781,942
DATED : July 21, 1998
INVENTOR(S) : Charles S. Allen, et. al.

It is certified that error appears in the above-identified patent and that said Letters Patent is hereby corrected as shown below:

Title page, item [75], Inventors: should read -- Daniel C. Shaw and Lee M. Adler, both of Florida--.

Signed and Sealed this

Seventeenth Day of November, 1998

Bruce Lehman

*Attest:*

BRUCE LEHMAN

*Attesting Officer*

*Commissioner of Patents and Trademarks*